United States Patent [19]

Bennett et al.

[11] Patent Number: 4,543,972

[45] Date of Patent: Oct. 1, 1985

[54] LOCKABLE TENT STAKE

[76] Inventors: James F. Bennett; Edward A. Bennett, both of 11181 E. HJ Ave., Galesburg, Mich. 49053

[21] Appl. No.: 512,030

[22] Filed: Jul. 8, 1983

[51] Int. Cl.[4] ..... A45F 1/16

[52] U.S. Cl. ..... 135/118

[58] Field of Search ..... 135/118

[56] References Cited

U.S. PATENT DOCUMENTS

| | | | |
|---|---|---|---|
| 787,719 | 4/1905 | Blair, Jr. | 135/118 X |
| 1,400,445 | 12/1921 | Lofquist | 135/118 |
| 1,781,350 | 11/1930 | Taylor | 135/118 |
| 4,258,514 | 3/1981 | St. Clair | 135/118 X |

FOREIGN PATENT DOCUMENTS

| | | | |
|---|---|---|---|
| 1291063 | 3/1962 | France | 135/118 |
| 27432 | 9/1908 | United Kingdom | 135/118 |

*Primary Examiner*—Robert A. Hafer
*Assistant Examiner*—Arnold W. Kramer

[57] ABSTRACT

This invention is a lockable tent stake, including a pair of metal clamp plates, several Allen head screws for securing the plates together by means of an Allen screwdriver, a pivotal covering plate, a ground stake and a padlock.

4 Claims, 5 Drawing Figures

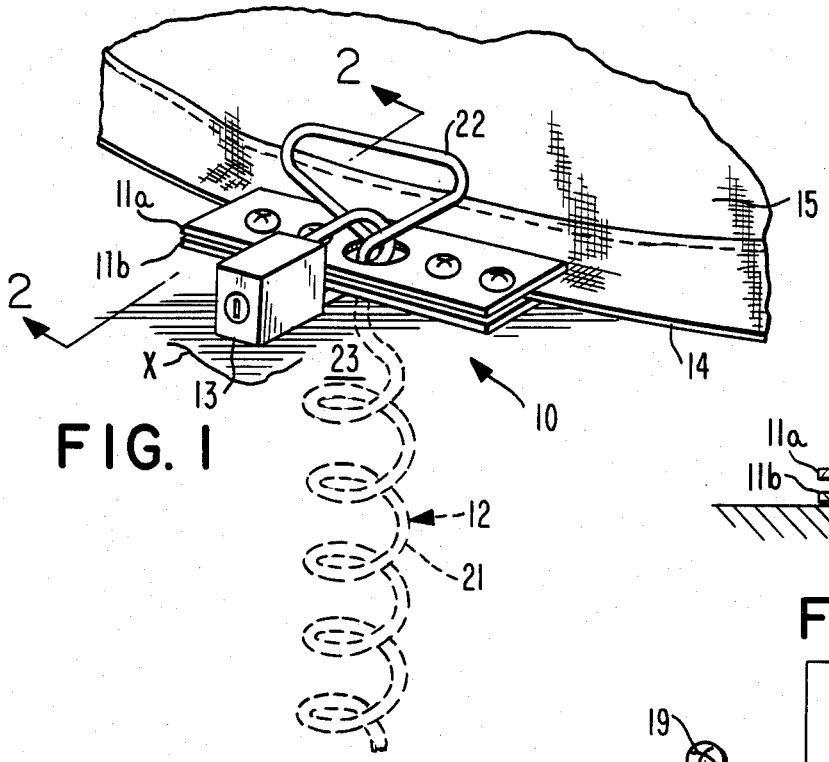
FIG. 1
FIG. 2
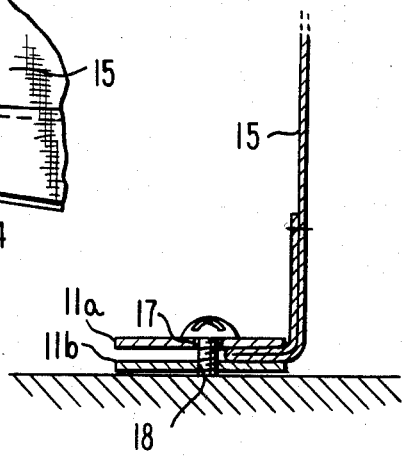
FIG. 3
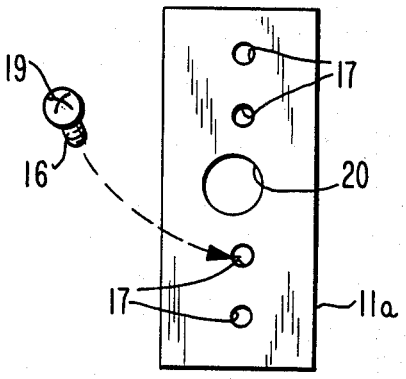
FIG.4
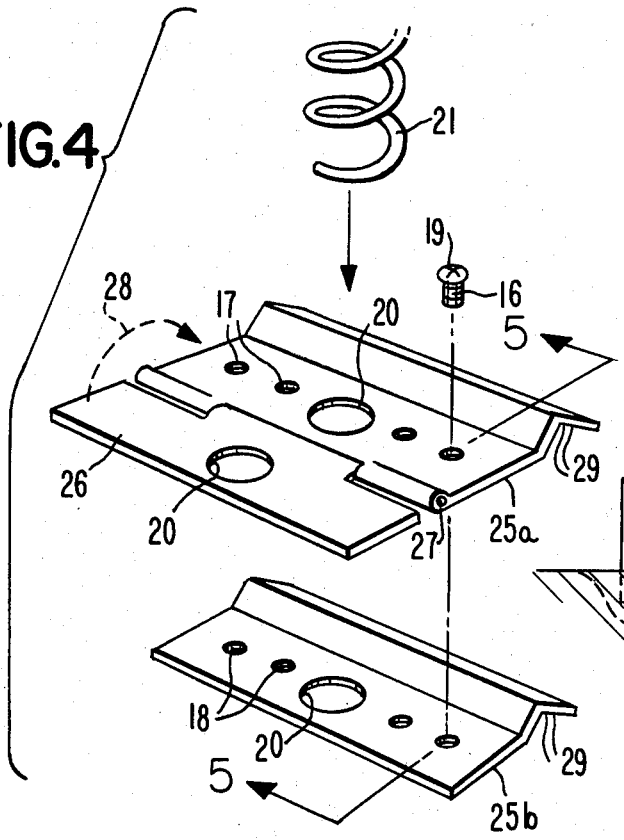
FIG. 5
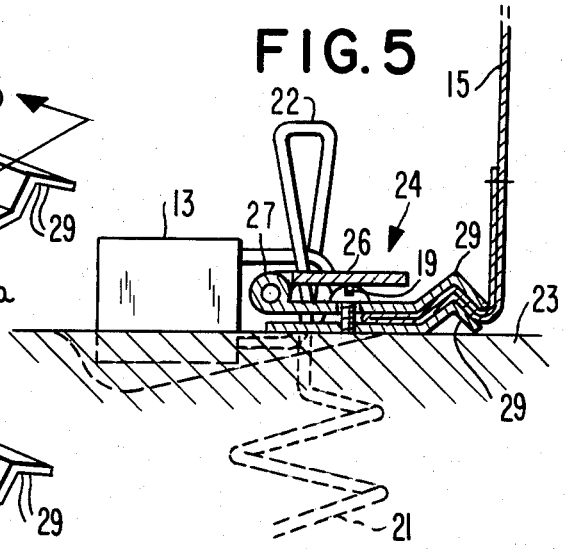

LOCKABLE TENT STAKE

This invention relates generally to tent accessories. More specifically, it relates to ground anchoring devices.

It is well known to campers living in tents that, when they leave their set up tent unattended, in order to go fishing or other activity elsewhere, there is always the risk of a thief breaking in, and even stealing the tent itself. Tents are usually set up by simply being draped over a frame of poles and ropes, while lower edges are tied to ground stakes by means of ropes, so that it is easy to remove them quickly. This situation is objectionable, and is, therefore, in need of an improvement.

Accordingly, it is a principal object of the present invention to provide a ground stake that clamps to a lower edge of a tent in a locked manner, so that the tent cannot be disengaged therefrom without damaging the tent, so that this will discourage a thief wanting to take a damaged tent.

Another object is to provide a lockable tent stake, that is screwed into the ground, so that it cannot be pulled straight out of the ground, such as a conventional straight stake; the present invention including means to prevent the stake being unscrewed by a thief.

Yet another object is to provide a lockable tent stake, which can be quickly and easily installed or dismantled by the tent's rightful occupant.

Yet a further object is to provide a lockable tent stake, that is compact, requires no maintenance, is adaptable for installation on all various models of tents, does not interfere with any other parts of the tent, requires no special skills or special tools other than an Allen screwdriver for installing, and which will prevent the tent from being blown away in a high wind.

Other objects of the present invention are to provide a lockable tent stake, which is simple in design, inexpensive to manufacture, rugged in construction, easy to use and efficient in operation.

These, and other objects, will be readily evident upon a study of the following specification and the accompanying drawing wherein:

FIG. 1 is a perspective view of the invention, shown assembled and in use, securing a lower edge of a tent;

FIG. 2 is a cross-sectional view, taken on line 2—2 of FIG. 1;

FIG. 3 is a top plan view of a typical one of the clamp plates;

FIG. 4 is a perspective view of a modified design of the clamp plates; one of which includes a pivotable shield, so as to cover up the heads of the screws, in order that they are inaccessible for being unscrewed, and both clamp plates including a pleat for grasping the tent canvas more firmly therebetween, and FIG. 5 is a cross-sectional view, taken on line 5—5 of FIG. 4, and showing the device assembled and in use.

Referring now to the drawing in greater detail, and more particularly to FIGS. 1 and 3 thereof, at this time, the reference numeral 10 represents a lockable tent stake, according to the present invention, wherein there are a pair of hard metal plates 11*a* and 11*b*, a ground stake 12 formed from a hard metal rod, and a conventional padlock 13.

The plates are generally rectangular in shape and the same size, so that, together, they form clamp jaws, between which a lower hemmed edge 14 of a canvas tent 15 may be clamped, when the plates are tightly held together by means of several screws 16 inserted into a row of aligned holes in the two plates. On one of the plates, these holes comprise clearance holes 17, while on the other plate they are threaded holes 18. The screws are provided with Allen head screwdriver slots 19, so as to be not likely to be unscrewed by a thief, unless provided with such specific type of screwdriver. A large central hole 20 in each plate, aligned together, receive the ground stake and the padlock.

The ground stake is formed with a long spiral 21 at one end, while an opposite end is formed into a large handle loop 22, that may be welded, so as to prevent a thief trying to pry open the loop.

In the installation of the present invention, two such lockable tent stakes 10 will be usually sufficient for most tents. They may be retailed in a kit including an Allen head screwdriver. Each pair of plates is, first, clamped firmly to a lower edge of the tent, as shown in FIGS. 1 and 2, after which the ground stake is threaded through the holes 20, and is screwed down into the ground 23 all the way, until the loop is adjacent the upper plate. The padlock is then inserted through the loop 22 and also through the aligned holes 20, as clearly shown in FIG. 1, and the padlock is then snapped shut in a locked position. It is to be noted, that it may be necessary to scrape away a little of the earth underneath the center of the plates in order to provide clearance for the padlock to loop therearound. Thus locked, the ground stake cannot be pulled straight up nor unscrewed, and the firmly clamped tent edge cannot be pulled loose. For additional security, the plates may be installed with the screw threaded one being on the top, so as to hide the Allen screw heads by positioning them inaccessibly underneath, against the ground.

Alternately, in a modified design 24 of the invention shown in FIGS. 4 and 5, the upper clamp plate 25*a*, having the clearance holes 17, includes a cover plate 26 pivotally attached thereto by a hinge 27; the plate 26 including only a hole 20 for receiving the ground stake and padlock, but having no holes for the screws. In use, the plate 26 is pivoted above the plate 25*a*, as indicated by arrow 28, thus enclosing the Allen screw heads from accessibility. Additionally, as shown, both the clamp plates 25*a* and 25*b* include mating pleats 29, in order that the tent material therebetween is more firmly frictionally grasped.

While various changes may be made in the detail construction, it is understood that such changes will be within the spirit and scope of the present invention, as is defined by the appended claims.

What is claimed as new is:

1. A lockable tent stake, comprising, in combination, a clamp for clamping to a lower edge of a tent, a ground stake for insertion through said clamp and into the ground, and a padlock for padlocking through said clamp and through said stake for preventing removal of said ground stake from said ground and said clamp; said clamp comprising a pair of clamp plates between which said tent lower edge is clamped, headed removable fastening means each received in mating holes of said plates for securing said plates together and holding said clamp in a locked position, and means to prevent access to said headed removable fastening means; said ground stake comprising a strong metal rod bent at one end into a long spiral for screwing into said ground and being bent at its other end into a large handle loop; and said means to prevent access being a cover plate hinged to one of said pair of clamp plates to pivotally cover the heads of said headed means, a stake-receiving opening in each said pair of clamp plates and said cover plate, said stake-receiving openings being aligned with each other when said cover plate is pivoted over to cover said heads; and said padlock being inserted through said ground stake handle loop and also through all said aligned stake-receiving openings.

2. The combination as set forth in claim 1, wherein said headed removable fastening means are Allen head screws.

3. The combination as set forth in claim 2, wherein the Allen head screws are arranged in a row.

4. The combination as set forth in claim 3, wherein said lockable tent stake is made up into a kit.

* * * * *